US005709069A

United States Patent [19]

Cronauer

[11] Patent Number: 5,709,069

[45] Date of Patent: Jan. 20, 1998

[54] PACKAGING MACHINE AND METHOD

[75] Inventor: William M. Cronauer, Tallmadge, Ohio

[73] Assignee: Automated Packaging Systems, Inc., Streetsboro, Ohio

[21] Appl. No.: 804,125

[22] Filed: Feb. 20, 1997

[51] Int. Cl.[6] ..... B65B 39/04; B65B 43/12; B65B 43/26; B65B 43/36

[52] U.S. Cl. ..... 53/459; 53/469; 53/570; 53/385.1; 53/389.2

[58] Field of Search ..... 53/459, 469, 570, 53/578, 385.1, 389.2, 389.1

[56] References Cited

U.S. PATENT DOCUMENTS

| | | | |
|---|---|---|---|
| 3,527,021 | 9/1970 | Pitts, Jr. et al. | 53/385.1 |
| 3,753,331 | 8/1973 | Sato | 53/385.1 X |
| 3,754,342 | 8/1973 | Santacroce et al. | 53/385.1 X |
| 3,897,676 | 8/1975 | Membrino | 53/385.1 X |
| 3,948,015 | 4/1976 | Lerner | 53/385.1 X |
| 3,956,866 | 5/1976 | Lattur | 53/385.1 X |
| 4,798,042 | 1/1989 | Davis | 53/385.1 X |
| 5,094,061 | 3/1992 | Evers | 53/570 X |
| 5,394,676 | 3/1995 | Lerner et al. | 53/459 |
| 5,442,898 | 8/1995 | Gabree et al. | 53/385.1 X |
| 5,485,714 | 1/1996 | Montalvo | 53/385.1 X |

*Primary Examiner*—Horace M. Culver
*Attorney, Agent, or Firm*—Watts, Hoffmann, Fisher & Heinke Co., L.P.A.

[57] ABSTRACT

A system for packaging thin products such as compact discs in plastic bags is disclosed. A CD dispenser is used in combination with a known but modified bagging machine. The modifications include an improved guide arrangement for guiding a gravity fed disc toward an open bag and a load station which includes a tunnel housing the open bag and of only slightly greater thickness dimension than the bag including the product to be packaged. As an end bag of a web of interconnected, preopened bags is fed into the tunnel, a flow of air is established behind the web to create a film of air spacing the back of the end bag from a wall of the tunnel. The flow of air also has the unexpected property of creating a venturi like effect to draw the end bag away from a front wall of the tunnel. A method of packaging thin objects such as compact discs is also disclosed.

30 Claims, 4 Drawing Sheets

PACKAGING MACHINE AND METHOD

This invention relates to packaging and more particularly to a novel and improved method and apparatus for packaging discs.

BACKGROUND OF THE INVENTION

Compact discs, now known simply as "CD's", frequently are individually packaged in cardboard, envelope like, containers. On other occasions the packaging is more sophisticated utilizing Such things as hinged plastic enclosures with a CD positioning insert.

Plastic films are now widely utilized in packaging. Such packages are advantageous for many applications because when dear plastic is used its clarity permits visual inspection of the contents, the plastics are readily printable and they are inexpensive. While plastic film packages have enjoyed popularity, they have not been used for packaging thin disc products such as CD's, primarily because there has been no effective, inexpensive method and apparatus for packaging them. Accordingly, it would be advantageous if there existed an efficient and inexpensive method and apparatus for providing individual plastic packages for CD's.

SUMMARY OF THE INVENTION

The machine of the present invention utilizes a novel and improved load station assembly mounted on a bagging machine sold by the assignee of this patent under the designation HS-100 Excel. The current machine, while modified and improved, is nonetheless essentially the machine described and claimed in U.S. Pat. No. 5,394,676, issued May 7, 1995, under the title Packaging Machine and Method (here the Excel Patent). The Excel Patent is incorporated by reference in its entirety.

A CD dispenser is mounted atop the Excel machine. The dispenser is described and claimed in a concurrently fled application entitled Disc Packaging Machine & Method, attorney's docket 14-171 (herein the Dispenser Patent). The Dispenser Patent is hereby incorporated by reference in its entirety.

With the machine of the Excel Patent an elongated web or chain of interconnected preopened bags is fed sequentially to position each end one of bags in a load station. Once the positioned bag has received a product it typically is closed and sealed and separated from the web such that a package is formed.

With the machine of the present invention a novel and improved load station is provided. As an end bag of the web is fed out of the machine it is gravity positioned in a tunnel which delineates the load station. The tunnel is of a width larger than the bags being fed and a thickness only slightly greater than the thickness of the bags plus a thin product to be packaged.

An air guide is positioned under the web path of travel to direct a flow of air downwardly between a plate delineating the back of the tunnel and a bag being fed into the load station. Air flow from the air guide creates a lubricating film of air between a bag being fed into the tunnel and a backing plate defining the back of the tunnel.

Unexpectedly the coaction of the flow of air from the air guide on the bag as it enters the tunnel is effective to maintain the bag out of contact with a plate defining the front of the tunnel as a bag is fed to the load station. Once a bag is positioned in the tunnel for loading, air flow from the air guide is terminated. The air guide includes a transversely elongate plenum with an elongated thin outlet. The outlet has its longitudinal dimension which is orthoganal to the web path of travel. The outer edge of a body defining the bottom of the outlet is radiused so escaping air follows the surface in a wing foil like action.

In prior Excel machines the air guides function to assure that the web path of travel is away from the machine and that descending bags will not hang up on parts of the Excel machine. Here the air flow from the air guide assures that an end bag of the web will not only feed into the tunnel, but will do so without contacting walls of the tunnel. Without the flow of air from the air guide bags will not feed into the tunnel.

The tunnel is defined by a formed metal tunnel plate connected to the backing plate. The backing plate is fixed to the machine. The backing plate is a standard plate used for other applications modified to provide a mounting for the tunnel plate.

A support plate is provided above the web path. The support plate differs from a standard plate used on Excel machines in that it has an arcuate cut out to protect against contact with the face of the disc. The support plate also differs in that it is modified to support a guide plate. The guide plate serves to guide a gravity deposited disc into a positioned and opened bag in the tunnel. The guide plate is designed to engage edges of the disc and avoid contact with the disc face which is the data storage side of the CD.

The tunnel plate has end mounting portions juxtaposed against and secured to the backing plate. An offset central portion is spaced from the backing plate a distance only slightly greater than the thickness of the bag and a disc to be packaged. The tunnel plate includes an upwardly and outwardly flaring guide portion connected to the central portion to assure that a bag being fed into the load station and a disc dropped into a positioned bag are guided into the tunnel and, in the case of the disc, into an open bag. Intermediate outwardly flaring side sections connect the central portion to the end mounting portions and delineate the sides of the tunnel which in the preferred and disclosed embodiment has a width only slightly larger than a bag being loaded and sealed to form a package. Since the side sections flare outwardly from the central portion, any contact with a CD being dropped into a bag will be with a rearward edge and not the delicate face of the CD.

In operation bags are fed from a bagging machine in the usual manner. As an end bag of the web descends from output rolls of the bagger, the air guide behind the web path of travel emits a downward flow of air behind the end bag, such that a film of air is established between the end bag and the backing plate. As we have suggested, this film of air has the unexpected property of establishing a venturi like action which keeps the end bag spaced from the tunnel plate as the bag is fed into the tunnel.

Once the end bag is in the tunnel a second source of air, this one an air knife above the path of travel, directs a burst of air through the preformed opening of the end bag to expand the bag for receipt of a product. Since the tunnel has a small thickness dimension the bag opening is limited and a relatively large transverse dimension is maintained so the bag can receive a CD or other like shaped object. A CD is then dropped into the bag, a sealer pad is closed against the bag to clamp it against a seal bar and effect a seal of the now loaded end bag. Concurrently with the seal formation, the bagging machine reverses the web feed to separate the now loaded end bag from the web. Once the seal pad is opened the now finished CD package is dropped onto a conveyor or into a suitable receiving receptacle.

Accordingly, the objects of the invention are to provide a packaging machine with a novel and improved load station delineating structure and a method of loading thin products, such as CD's into bags to form packages.

DETAILED DESCRIPTION OF THE INVENTION

Figure 1:
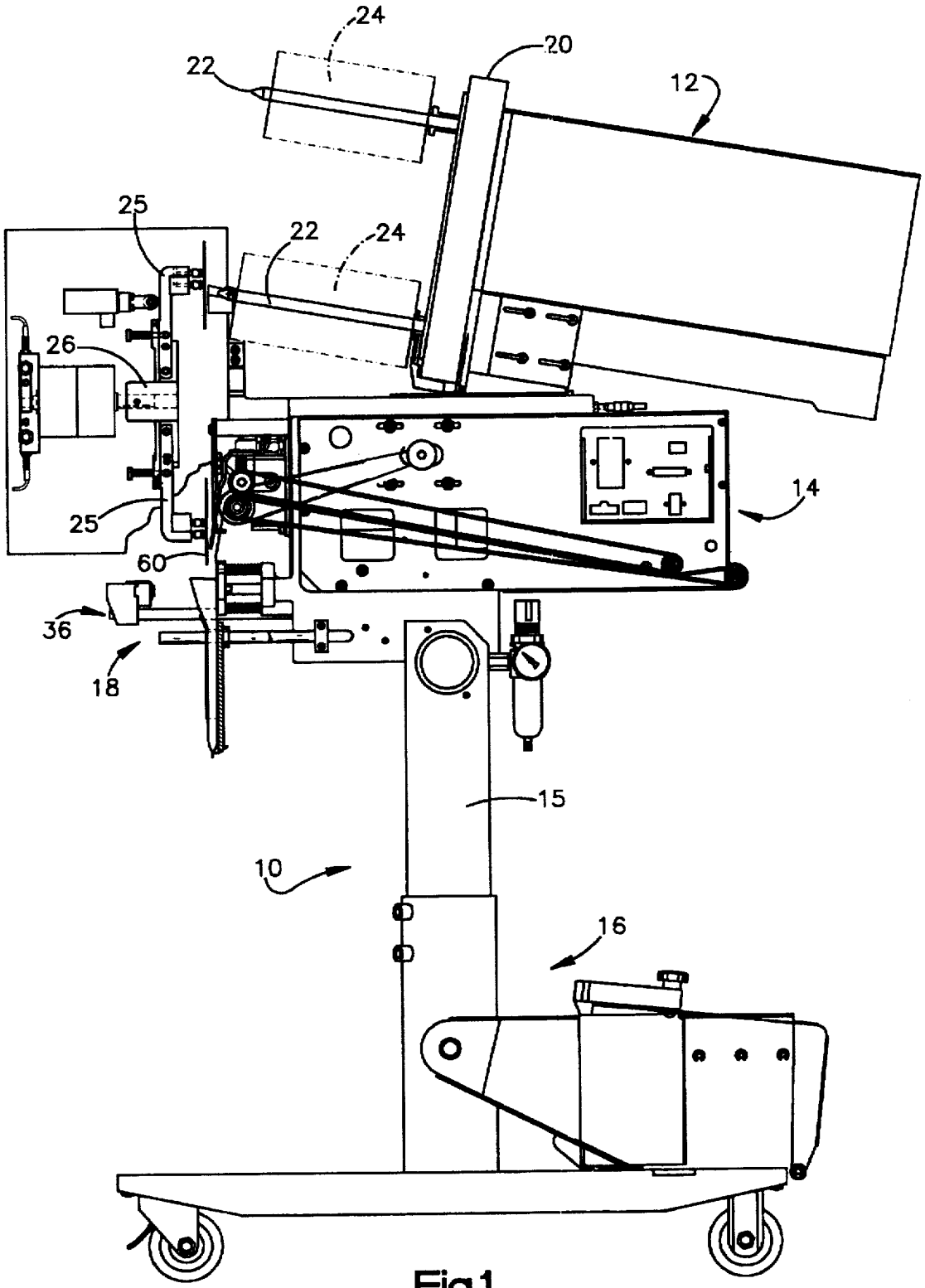
FIG. 1 is a side elevational view in somewhat schematic form of the machine of the Excel Patent with the CD dispenser of the Dispenser Patent mounted atop it.

Referring now to the drawings and FIG. 1 in particular, the machine of the Excel Patent is shown somewhat schematically at 10. The mechanism of the Dispenser Patent 12 is mounted atop the bagging machine 10. The machine 10 includes a bagger 14 supported by a frame 15. A chain of interconnected, preopened bags (not shown) is fed from a supply station 16 to the bagger and thence to a packaging station shown generally at 18. The operation of the bagger is described in the Excel Patent and accordingly will not be repeated here.

The CD dispenser 12 includes a turret 20 which supports a plurality of mandrels 22. The mandrels 22 each support a different stack of CD's shown in dotted lines of 24. The construction and operation of the CD dispenser is described fully in the Dispenser Patent and accordingly the details of it are not repeated here.

The dispenser 12 includes a pair of pickup and dispensing arms 25 which are supported by a rotatable boss 26. The upper one of the arms 25 as viewed in FIG. 1 functions to pickup CD's sequentially and one at a time from a positioned stack of CD's 24. Upon 180° rotation of the boss 26, the picked up disc is transferred to a dispensing position as shown by the lower one of the arms 25 in FIG. 1 and 2.

Figure 2:
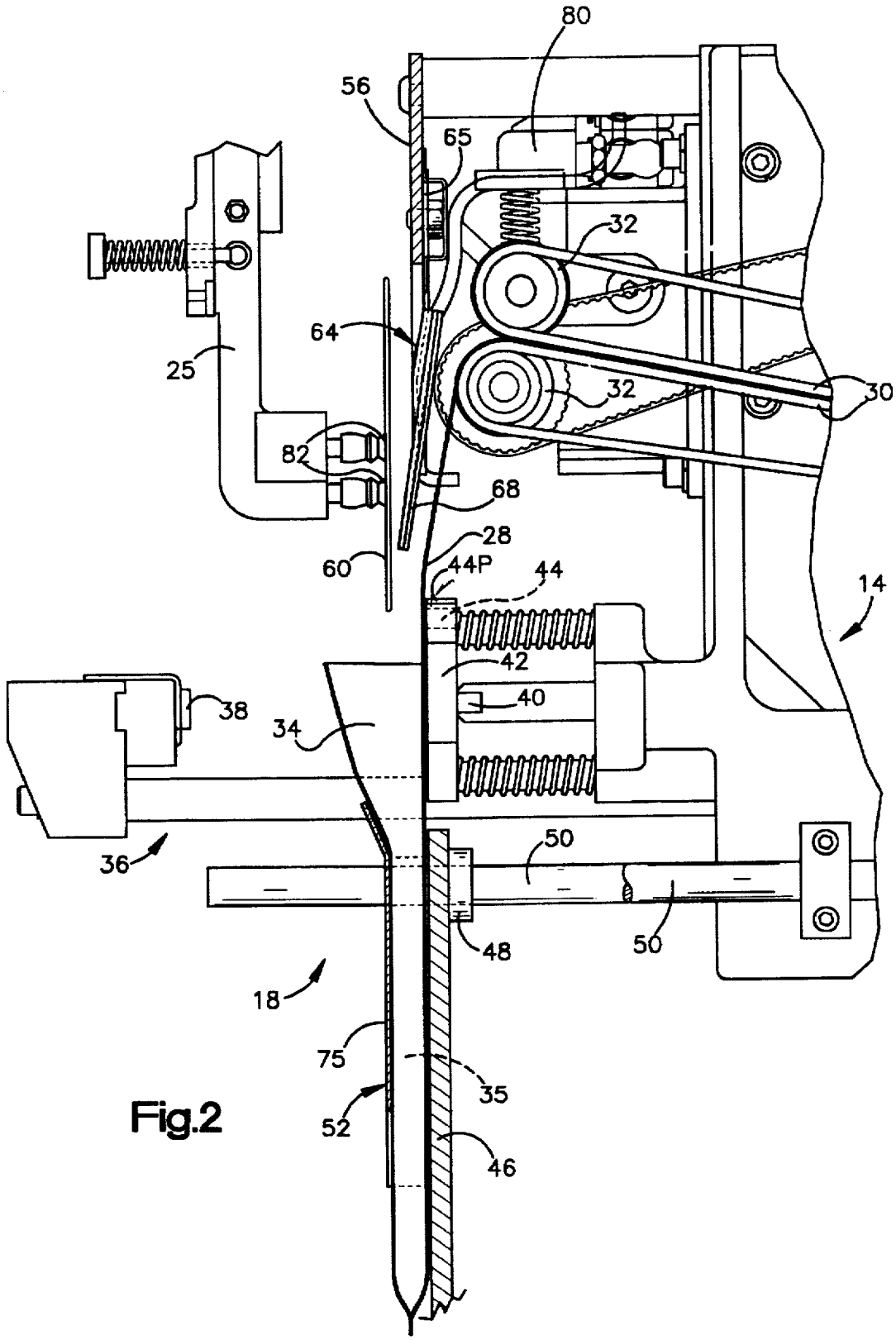
FIG. 2 is an enlarged partially sectioned and partially side elevational view of feed and sealer portions of the bagger and of the novel and improved guide and tunnel arrangement of this invention.

Referring now to FIG. 2, a web of preopened and interconnected bags 28 is fed by a pair of belts 30 to an outlet pair of nip rolls 32. As the web exits the nip rolls, it drops under the influence of gravity into the load station 18 until an end one of the bags 34 is positioned within a tunnel 35.

Figure 5:
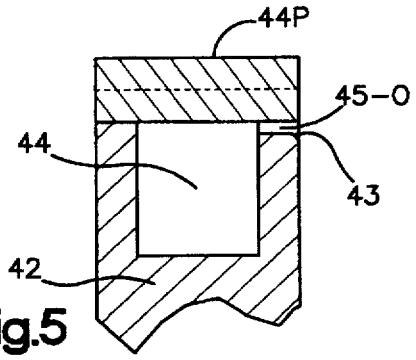

The load station includes a seal mechanism shown generally at 36 which is above the tunnel 35. The seal mechanism includes a reciprocally mounted sealer pad 38, a sealer bar 40 and a spring mounted bar protector plate 42. The protector plate 42 includes an air guide chamber 44 connected via an inlet 45I to a source of air under pressure, not shown. The chamber 44 is substantially enclosed by a cover plate 44-P, FIG. 3. An elongate thin slot portion is milled from the protector plate 42 to leave an elongate thin frontal outlet 45-0 between the plates 42, 44-P for emitting a stream of air as the web 28 is advanced to position an end bag 34 in the tunnel 35. As is best seen in FIG. 5, the slot portion has a radiused portion 43. Escaping air flow follows the radius in a wing foil like action such that a relatively wide flow of escaping air under pressure flows downwardly behind the bag web 28.

Figure 4:
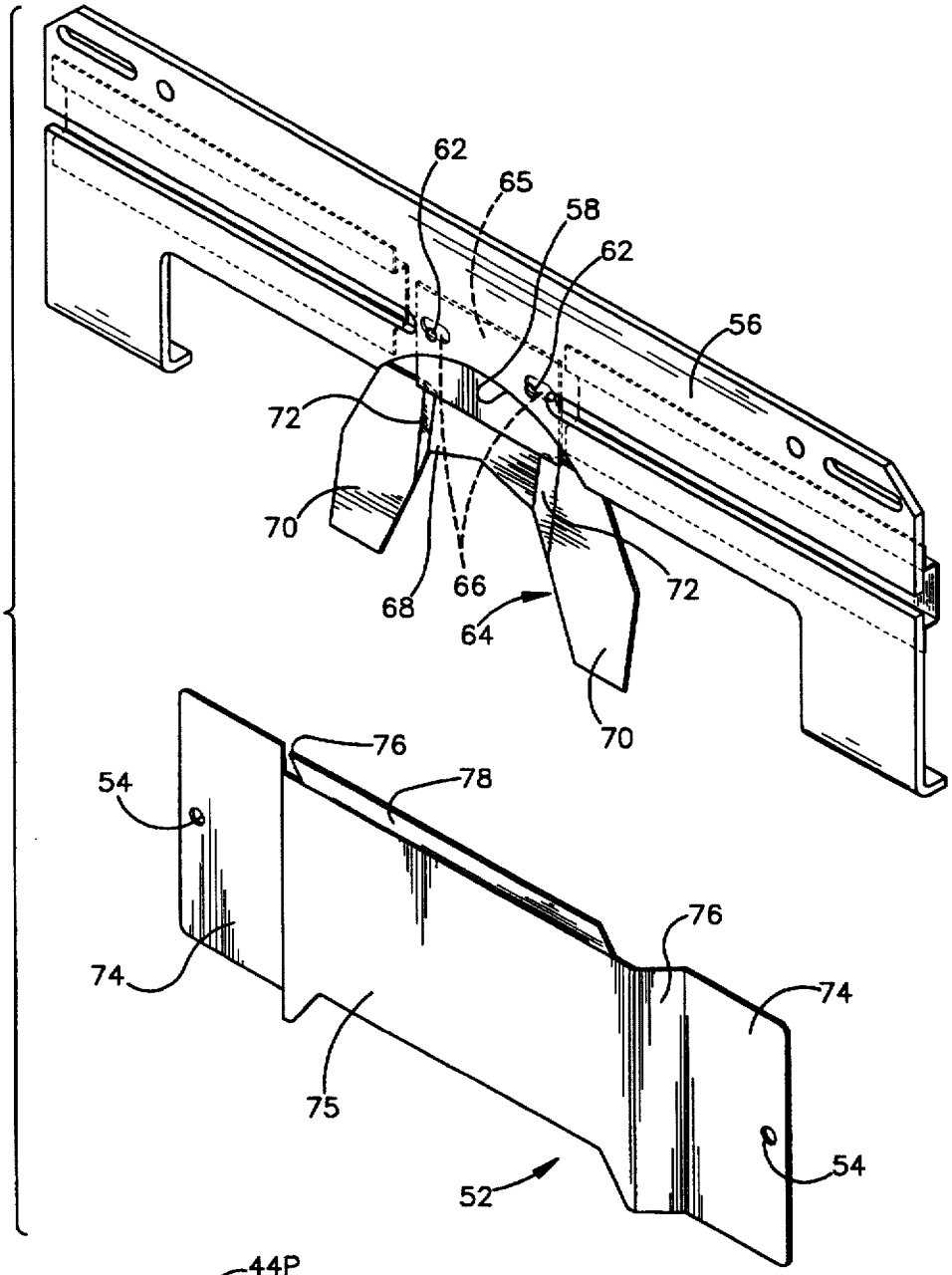
FIG. 4 is an exploded perspective view of the support, guide and tunnel plates of the present invention; and, FIG. 5 is a sectional view of the air guide as seen from the plane indicated by the line 5—5 of FIG. 3.

The flow of air from the chamber 44 establishes a film of air between the end bag 34 and a backing plate 46, FIGS. 2 and 4. The backing plate 46 is suitably connected as by clamps 48 to a pair of support rods 50. The rods 50 are connected and project from the bagger 14 as best seen in FIG. 2. The front of the tunnel 35 is delineated by a tunnel plate 52 secured to the backing plate 46 by fasteners, not shown, which project through fastener apertures 54, FIG. 4. Thus, the backing and tunnel plates 46,52 have internal walls which define the tunnel 35.

Figure 3:
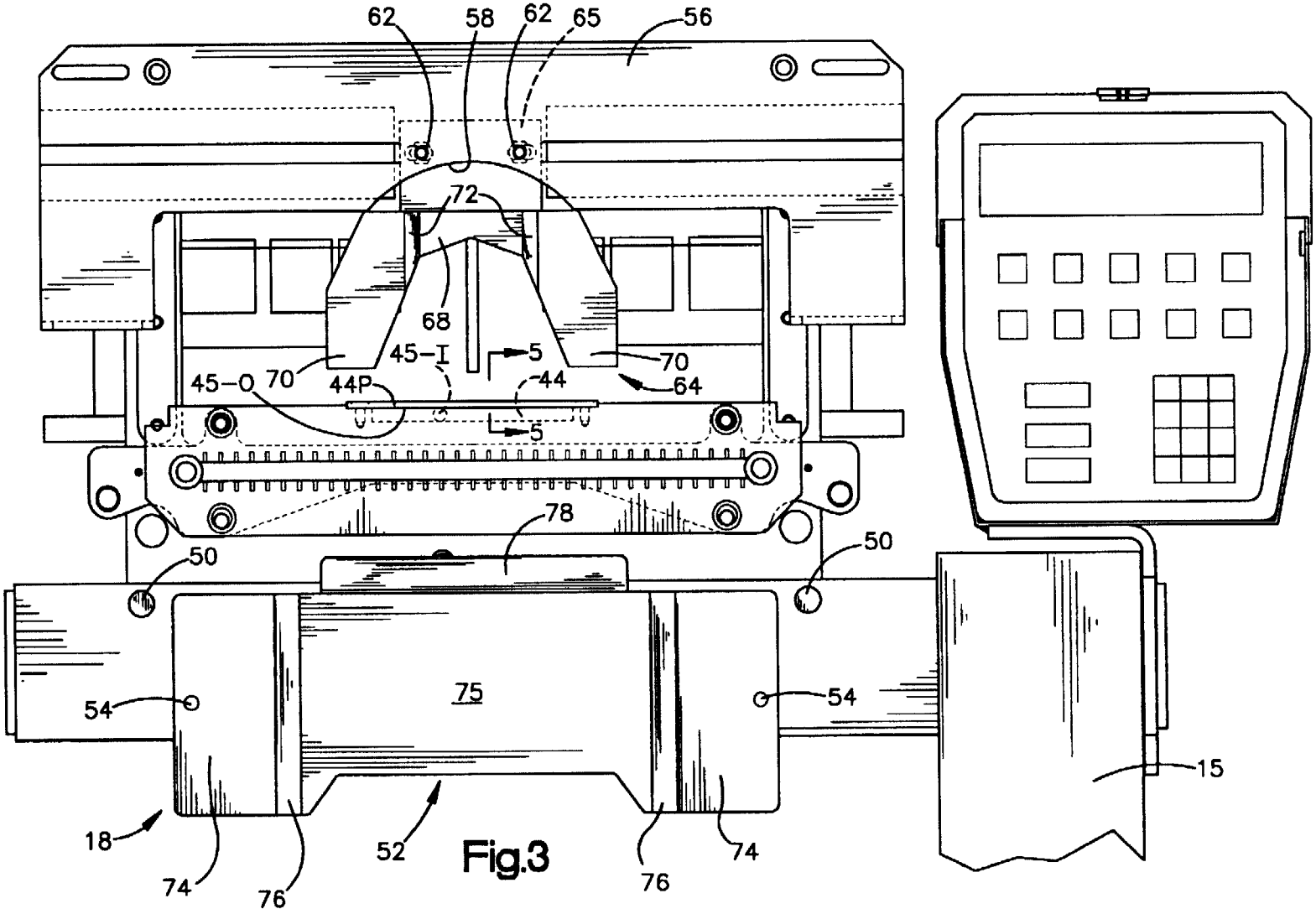
FIG. 3 is a front elevational view on an enlarged scale with respect to FIG. 1 and a reduced scale with respect to FIG. 2 of the bag dispensing portion of the bagger equipped with the guide and tunnel mechanism of the present invention.

A support plate 56 is mounted on a face of the bagger 14 above the path of web travel, FIGS. 2 and 3. The support plate 56 is a standard component of the machine of the Excel Patent modified to provide the improved system of the present invention. Specifically, as best seen in FIG. 4, an arcuate cut-out 58 is provided in order that a disc 60 when dispensed from the lower of the pickup arms 25 will not be interfered with by the support plate.

The support plate 56 is further modified to provide a pair of threaded apertures 62. A guide plate 64 is provided. The guide plate has an upper mounting part or tab 65 including a spaced pair of apertures 66. Fasteners, not shown, extend from behind the guide plate 64 through the apertures 66 and threadedly engage the threaded apertures 62 to secure the guide plate 64 to the support plate 56.

As best seen in FIGS. 3 and 4, the guide plate 64 includes a central connecting part 68 which extends downwardly and outwardly at an obtuse angle with respect to the mounting part 65 as measured in an imaginary plane vertically bisecting the mounting part. The guide plate 64 also includes a spaced pair of side guide arms 70 which project downwardly and outwardly at obtuse angles with respect to the connecting part 68 as measured in a second imaginary plane orthogonal to the bisecting plane. The guide plate has flaring parts 72 which flare forwardly and outwardly from the connecting part 68 and interconnect the guide arms 70 with the connecting part.

As is best seen in FIGS. 2 and 4, the tunnel plate 52 includes a spaced pair of mounting tabs 74 which include the fastener apertures 54. The tunnel plate has a central portion 75 spaced forwardly from the mounting tabs 74 and connected to them by a spaced pair of flaring portions 76. The tunnel plate 52 also includes a guide flange 78 which extends upwardly and outwardly from the central portion 75. The guide flange 78 functions to assure that an end bag 34 is guided into the tunnel 35 as it is fed downwardly and assure that the top of the bag flares outwardly when it is opened. Similarly, the guide flange 78 functions to assure that a dropped lower disc 60 is cammed into and enters the positioned and opened end bag 34.

OPERATION

First, the set up procedures described in connection with the bagging machine 10 in the Excel Patent and the dispenser 12 in the Dispenser Patent, are performed. Assuming both the machine and the dispenser 10,12 are ready for operation, the bagger 14 is energized to feed the web outwardly and downwardly until the end bag 34 is positioned in the tunnel 35. As the web is fed to position the end bag, air under pressure is supplied to the air guide chamber 44 and air exiting the outlet 45 flows downwardly along the web to establish an air film between the end bag 34 and the tunnel wall of the backing plate 46. Concurrently, with a venturi like effect, this flow of air causes the front of the end bag 34 to stay sufficiently clear of the tunnel wall of the central portion 75 to allow the bag to fall readily and freely into the tunnel 35.

Once the end bag 34 is located at the load station 18, the supply of pressurized air to the chamber 44 is terminated and air under pressure is supplied to an air knife 80 to open the end bag 34 expanding the bag against the walls defining the tunnel and the top of the bag against the guide flange 78.

The disc 60 is now released from the arm 25 by terminating the vacuum drawn from tips 82, FIG. 2, and supplying a puff of air to cause the disc 60 to be released, all as described in greater detail in the Dispenser Patent. Should the disc 60 engage the guide plate only peripheral edges outboard of the delicate face will engage the forwardly and downwardly slanting guide arms 70. The disc 60 will then, under the gravitational influence, drop into the open end bag. If the disc is slightly forward relative to the bagger 14 of an appropriate path for descent into the opened bag 34, the guide flange 78 will function to guide the disc into the open bag. Any engagement will be with the perimeter or perhaps a marginal portion of the back of the disc opposite the delicate face of the disc which is directed toward the bagger.

Once the disc 60 is positioned within the bag 34, the flow of air from the air knife is terminated. The end bag 34 is sealed and the web feed belts 30 are driven in the reverse direction to separate the web from the end bag 34 all as described in greater detail in the Excel Patent.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. A method of packaging thin products utilizing a chain of interconnected preopened bags comprising:

a) feeding an end bag of the chain closed end first into an elongate, loading station delineating, tunnel;

b) as the end bag is being fed into the tunnel to position the end bag in the station establishing a flowing film of air between a back of the end bag and a back of the tunnel;

c) continuing the flow of air in the film of air to maintain the back of the end bag and tunnel in spaced relationship and concurrently provide clearance between fronts of the bag and tunnel;

d) opening the end bag sufficiently to enable insertion of a product as the bag is positioned in the station; and, e) inserting a thin product into the opened end bag.

2. The method of claim 1 further including the step of separating the end bag from the web.

3. The method of claim 2 wherein the end bag is closed and sealed as it is separated from the web.

4. The method of claim 1 wherein the step of inserting the product comprises a gravity feed of the product.

5. The method of claim 1 wherein the product is a compact disc.

6. The method of claim 1 wherein the flow of film forming air is terminated before the bag is opened.

7. The method of claim 6 wherein the bag is opened by a blast of air from a source other than the source of the flowing film.

8. The method of claim 1 wherein the bag is opened by a blast of air from a source other than the source of the flowing film.

9. The method of claim 1 wherein the flow of air for the film is supplied by an air guide having an elongate air outlet opening oriented transversely of the path of bag feeding.

10. In a packaging machine of the type wherein end bags of a chain of preopened interconnected bags are sequentially positioned in and loaded at a load station, the improvement comprising:

a) a frame structure;

b) a web feed connected to the structure for feeding such a chain along a path of travel to the load station;

c) a tubular mechanism connected to the structure, the mechanism delineating an elongate thin tunnel sized to be only slightly thicker than a bag at the load station with a product being packaged in the bag; and, d) a source of flowing air positioned behind the path of travel and oriented to direct a film of air into the tunnel and create a lubricating film of air between a back of the tunnel and the web as an end bag is fed into loading position in the load station.

11. The machine of claim 10 wherein the web feed is reversible for separating end ones of such chain from the chain.

12. The machine of claim 10 wherein the air source is an air guide having a thin, elongate outlet defined in part by a radius at an outer end of the outlet.

13. The machine of claim 10 wherein a second air source is provided for opening bags positioned in the tunnel.

14. The machine of claim 10 wherein the source of air is also positioned to provide an air flow which draws the bag away from a front of the tunnel.

15. The machine of claim 10 further including a guide plate above the tunnel for guiding a gravity deposited product into an opened bag located in the tunnel.

16. A method of loading products sequentially into bags of a chain of interconnected preopened bags fed sequentially and one at a time into a load station within an open ended tunnel having front and back faces comprising:

a) sequentially feeding bags one at a time into the load station;

b) as each bag is being fed into the tunnel to the load station maintaining the bag substantially free of contact with the faces of the tunnel by flowing air between the bag and one of the faces to establish an air film between the bag and the one face while concurrently maintaining the bag spaced from the other face;

c) sequentially loading products into the bags as they are sequentially positioned in the load station; and, d) removing loaded bags from the station.

17. The process of claim 16 wherein the bags are fed by and from a bagging machine along a path of travel and wherein said one face is defined by a machine part behind the path.

18. The process of claim 17 wherein the flow of air for the film is supplied by an air guide having an elongate air outlet opening oriented transversely of the path of bag feeding.

19. The process of claim 16 wherein the flow of air for the film is supplied by an air guide having an elongate air outlet opening oriented transversely of the path of bag feeding.

20. In a packaging machine of the type wherein end bags of a chain of preopened interconnected bags are sequentially positioned in and loaded at a load station, the improvement comprising:

a) a frame structure;

b) a web feed connected to the structure for feeding such a chain along a path of travel to the load station;

c) a tubular mechanism connected to the structure, the mechanism delineating an elongate thin tunnel sized to be only slightly thicker than a bag at the load station with a product being packaged in the bag;

d) the web feed being for feeding end ones of the bags to a load station and being reversible for separating end ones of such chain from the chain; and, e) an air guide flowing air positioned behind the path of travel and oriented to direct a film of air into the tunnel and create a lubricating film of air between a back of the tunnel and the web as an end bag is fed into loading position in the load station.

21. The machine of claim 20 wherein a second air source is provided for opening bags positioned in the tunnel.

22. The machine of claim 20 wherein the air guide is also positioned to provide an air flow which draws the bag away from a front of the tunnel.

23. The machine of claim 20 further including a guide plate above the tunnel for guiding a gravity deposited product into an opened bag located in the tunnel.

24. The machine of claim 20 wherein the air guide has a thin, elongate outlet defined in part by a radius at an outer end of the outlet.

25. In a bagger for sequentially packaging products in sequential end bags of a flattened web of interconnected and preopened bags, an improved product guide and load station delineating mechanism comprising;

a) a support plate mounted above a path of web travel to the load station;

b) a guide plate secured to and depending from the support plate;

c) a backing plate connected to the remainder of the bagger and positioned along a section of the web path of travel below a web exit from within the bagger;

d) a tunnel plate secured to the backing plate;

e) the backing and tunnel plates each having a central portion wall, the walls being spaced and defining a tunnel of a thickness slightly larger than the thickness of an end bag containing a product as such bag and product are being made into a package.

26. The mechanism of claim 25 further including an air guide for emitting a flow of air to form an air film in the tunnel between a back of an end bag in the tunnel and a back one of the walls while maintaining a front of such end bag substantially free of contact with a front one of the tunnel walls.

27. The mechanism of claim 25 wherein the guide plate includes a mounting tab and a depending central portion angled outwardly from the mounting tab at an obtuse angle as measured in an imaginary, vertically bisecting plane.

28. The mechanism of claim 27 wherein the guide plate further includes spaced side guide portions connected to the central portion by spaced flaring sections, the guide portions being at equal and opposite obtuse angles with the central portions as measured in a second imaginary plane which is a orthogonal to the bisecting plane.

29. The mechanism of claim 25 wherein the tunnel plate includes a central portion, a pair of spaced connecting portions flaring from opposite sides of the central portion and a spaced pair of mounting tabs respectively connected to the connecting portions.

30. The mechanism of claim 29 wherein the tabs are in a common plane spaced from a plane generated by the central portion.

* * * * *